United States Patent [19]

Crutcher

[11] 4,359,243

[45] Nov. 16, 1982

[54] MUSICIAN'S CHAIR

[76] Inventor: Lewis P. Crutcher, 25 Upper Alcatraz Pl., Mill Valley, Calif. 94941

[21] Appl. No.: 55,289

[22] Filed: Jul. 6, 1979

[51] Int. Cl.[3] ..... A47C 4/00; A47C 4/04

[52] U.S. Cl. ..... 297/16; D6/55; 297/17; 297/42; 297/186; 297/452

[58] Field of Search ..... 297/42; 186, 13, 14, 175, 297/15, 16, 423, 444, 52, 45, 46, 43, 17, 175; 4/185.5R, 185.55; 84/DIG. 3, DIG. 17, 453; D6/55; 108/38, 48; 190/8, 12.4; 296/64

[56] References Cited

U.S. PATENT DOCUMENTS

| | | | |
|---|---|---|---|
| D. 48,030 | 10/1915 | Herhold | D6/55 |
| 56,769 | 7/1866 | Loth | 108/112 |
| D. 182,245 | 3/1958 | Rabin | D6/55 |
| D. 248,697 | 8/1978 | Mller | D6/55 |
| 934,155 | 9/1909 | Friend | 190/8 |
| 1,597,834 | 8/1926 | Scudder | 108/34 |
| 1,735,921 | 11/1929 | Franzosa | 297/186 X |
| 2,148,086 | 2/1939 | Peters | 296/64 |
| 3,178,220 | 4/1965 | Kaake | 297/175 X |
| 3,193,848 | 7/1965 | Levy | 108/48 X |
| 3,469,880 | 9/1969 | Woodward | 297/423 |
| 3,565,485 | 2/1971 | Eisenhauer | 297/423 X |

FOREIGN PATENT DOCUMENTS

| | | | |
|---|---|---|---|
| 90397 | 5/1922 | Fed. Rep. of Germany | 296/64 |
| 430094 | 2/1967 | Switzerland | 108/34 |
| 293620 | 7/1928 | United Kingdom | 296/64 |
| 663478 | 12/1951 | United Kingdom | 108/115 |

*Primary Examiner*—James T. McCall

*Attorney, Agent, or Firm*—Fitch, Even, Tabin, Flannery & Welsh

[57] ABSTRACT

Various embodiments of a performer's chair are disclosed including a seat element having an elongated portion for supporting one leg, the oppositfe side of the chair being angularly cut away in order to permit freedom of movement for the performer and to facilitate positioning and manipulation of an instrument such as a guitar. A preferred embodiment includes a back rest for the performer, the seat cushion being hinged and one of three legs being formed by a hinged gate-leg to permit the chair to be folded up when not in use. Another embodiment includes a similar chair combined with a case for a musical instrument or the like.

14 Claims, 9 Drawing Figures

FIGURE 6
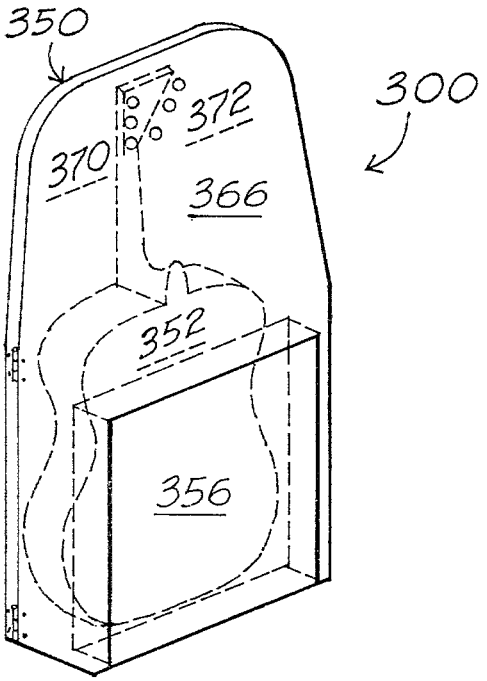
FIGURE 7
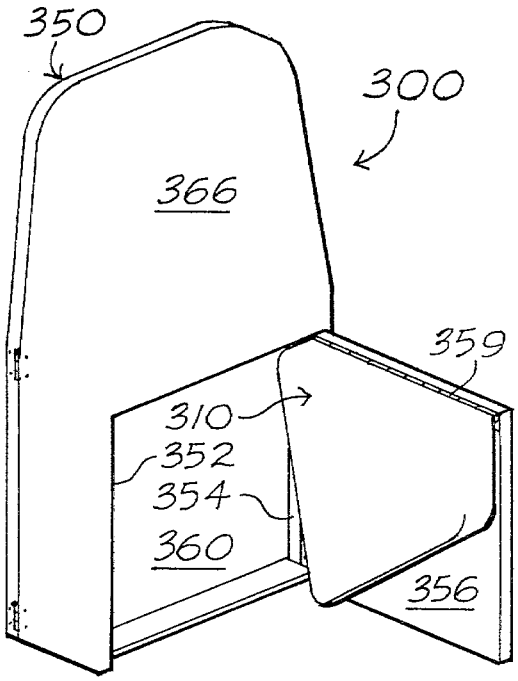
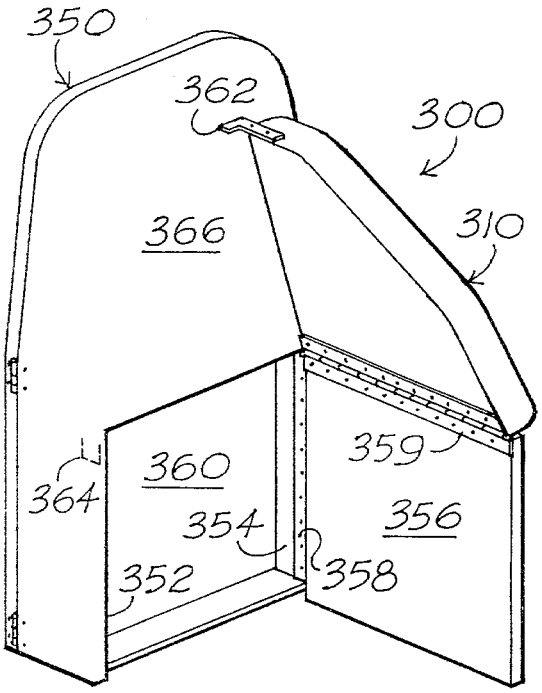
FIGURE 8
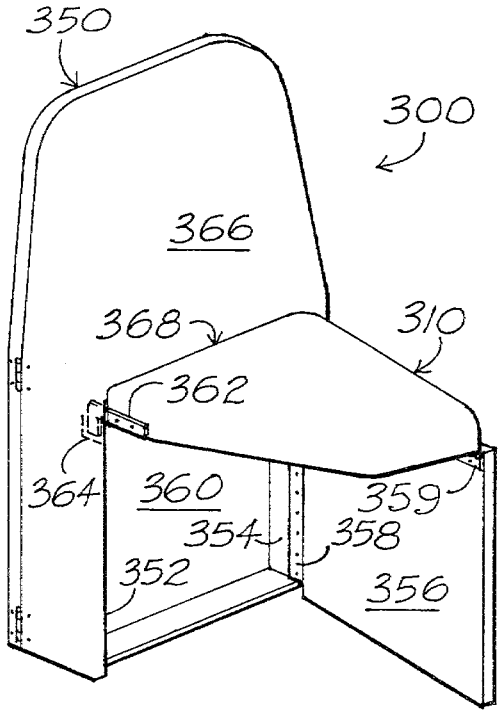
FIGURE 9

MUSICIAN'S CHAIR

The present invention relates to a performer's chair and more particularly to such a chair which is designed to maximize comfort of the performer, to facilitate positioning and manipulation of an instrument and to permit storage and transport thereof.

Many different designs of chairs have been employed by performing artists and musicians during performances on stage or elsewhere. Generally, performers have used conventional benches, chairs and stools having a simple seating element, either with or without a backrest. In employing such conventional chairs during musical performances or the like, the performer tends to experience some difficulty in achieving a comfortable position and in positioning and manipulating an instrument. Further, during an extended performance or practice, the performer generally finds it necessary or desirable to intermittently shift his position in order to remain comfortable and to permit him to best concentrate upon the performance. Chairs of the type referred to above have generally not been satisfactory for this purpose. For example, when using a stool or bench, the performer may place one foot on the floor and his other foot on a portion of the bench or stool itself. During an extended performance, the performer may shift the position of his feet or even place both feet upon various portions of the stool. In any event, it is believed obvious that such a stool is not designed to maximize comfort of the performer during a musical performance or the like. Similarly, with a chair having a relatively large rectangular seating surface, a performer sitting fully upon the chair tends to have both legs supported upon the seat so that it is difficult to move either or both legs during an extended performance. Accordingly, it is common for performers employing such a chair to sit toward one edge of the chair or on a leading edge of the chair in order to provide freedom of movement for at least one leg. In any event, the chair does not tend to provide proper or comfortable support for the performer.

Accordingly, there has been found to remain a need for a performer's chair having a design for facilitating comfort of the performer during an extended performance and preferably to facilitate storage or transport of the chair when it is not in use.

SUMMARY OF THE INVENTION

It is therefore an object of the present invention to provide a performer's chair having a functional design for achieving one or more advantages of the type discussed above.

More specifically, it is an object of the invention to provide a performer's chair having a seat element which is elongated upon one side for supporting one of the performer's legs, the other side of the seating element having an angularly cut-away portion in order to permit freedom of movement for the performer. Such a design has been found to particularly enhance performer comfort and to facilitate instrument positioning, especially during an extended practice or performance. The chair is preferably provided with triangular or three-point support formed, for example, by means of three legs in order to best support the seat element.

It is a further object of the invention to provide a performer's chair of the type referred to above wherein the chair is formed with a backrest to provide greater support for the performer.

Yet another object of the invention is to provide such a chair which can be folded up when it is not in use to facilitate storage or transport. In fulfilling this object, the three-point support for the seat may be collapsible with the seat element being hinged or pivotably mounted in order to permit the chair to be completely folded up. In a preferred embodiment of the chair having three legs as discussed above, the seat element is hinged to a member of the chair forming two of the legs, the third leg being formed as a gate-leg in order to facilitate folding the chair into a compact shape when not in use.

A still further object of the invention is to provide a chair of the type referred to above being particularly adapted for a musician or the like employing an instrument during the performance, the chair having a seat element formed in combination with a case for the instrument, the seat element being adapted to assume an upright position to form a chair for the performer and being foldable into a compact configuration along with the case to facilitate storage or transport. In a preferred embodiment of the invention, the instrument case itself forms a portion of the support for the seat element. The instrument case may additionally form a backrest for the performer.

Additional objects and advantages of the present invention are made apparent in the following description having reference to the accompanying drawings.

BRIEF DESCRIPTION OF THE DRAWINGS

FIGS. 6, 7, 8 and 9 are views of a chair constructed in combination with an instrument case, FIG. 6 illustrating the chair being folded into the case for storage or transport, FIGS. 7 and 8 illustrating the chair in intermediate unfolded positions to better show its construction, and FIG. 9 illustrating the chair in an erect position for use.

DESCRIPTION OF THE PREFERRED EMBODIMENTS

Figure 1:
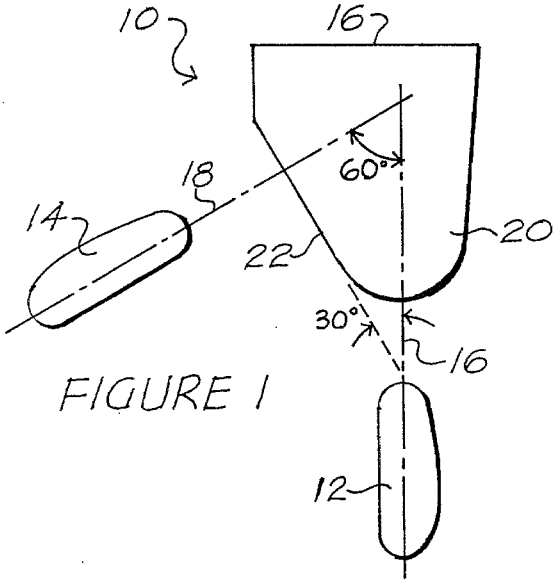
FIG. 1 is a plan view of a seat element for the chair of the present invention while schematically illustrating the manner in which the shape of the seat element supports and permits freedom of motion for a performer.
Figure 2:
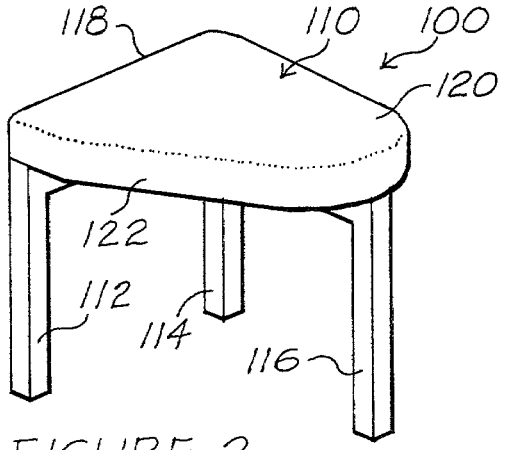
FIG. 2 is a representation of a simple embodiment of the chair in including three supporting legs.
Figure 3:
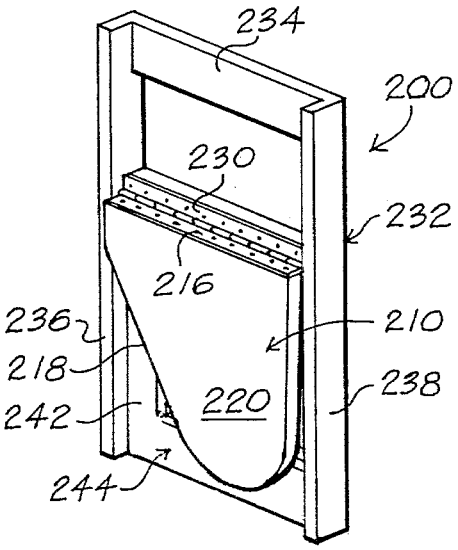
FIG. 3 is a view of a preferred embodiment of the chair including a backrest and having the seat element and a portion of the support formed by hinged elements permitting the chair to be folded into a compact configuration for transport or storage.
Figure 4:
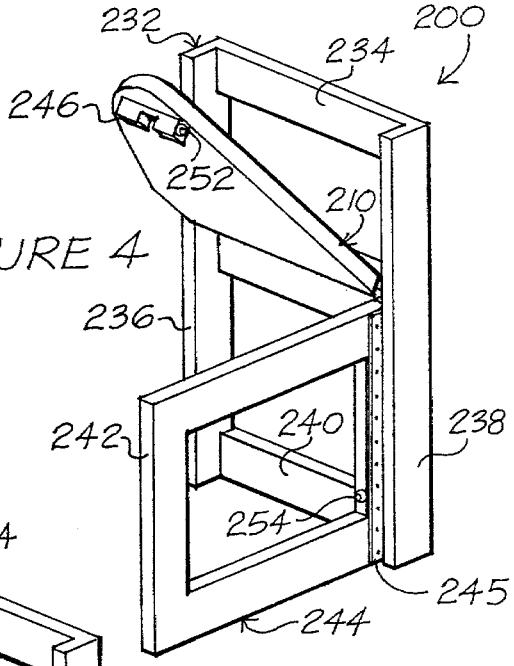
FIG. 4 is a further view of the same chair embodiment of FIG. 3 with portions of the chair being in intermediate positions to better illustrate its hinged or pivoted construction.
Figure 5:
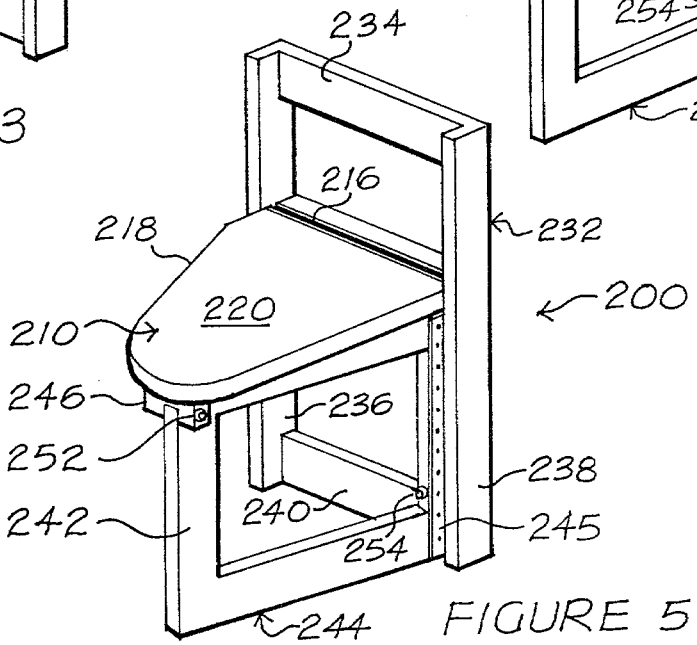
FIG. 5 is a view of the chair of FIGS. 3 and 4 in an erect configuration for use.

The present invention relates to a performer's chair having a number of preferred embodiments as described in detail below. To summarize these embodiments, the basic configuration of a seat element for the chair is illustrated in FIG. 1. FIG. 2 illustrates a particularly simple embodiment of the chair having three legs providing three-point support for the seating element. The embodiment of FIG. 2 could also be termed a "stool." FIGS. 3–5 illustrate a further preferred embodiment of the chair including a backrest and being foldable into a compact configuration for storage or transport. Yet another embodiment is illustrated in FIGS. 6–9 where the chair is formed as a portion of an instrument case, a seating element of the chair being adapted to be folded into the case for storage and transport or to be erected for use with the case preferably forming a support portion for the chair. These features and embodiments of the invention are described in greater detail below.

Referring initially to FIG. 1, a plan view of a seat element 10 includes a stylized representation of the position for the feet of a performer using the chair. Broken lines generally indicate the position of the performer's legs while he is sitting upon the chair. The general locations for the operator's left and right feet are illustrated respectively at 12 and 14 while the lines indicating the general position of the operator's legs are indicated at 16 and 18.

Referring specifically to the seat element itself, one side of the seat element 10 is formed with an elongated portion 20 extending generally along the line 16 to provide substantial support for one of the operator's legs while he is seated upon the stool. The broken line 16 also tends to indicate the axis or center line for the elongated portion 20. The opposite side of the stool is formed with an angular cut-away portion 22 which preferably intersects at right angle the line 18 representing the performer's other leg. The purpose of the angular cut-away 22 is to reduce the restrictive support for the performer's other leg as indicated by the line 18 in order to provide greater freedom of movement for the performer while he is sitting upon the chair. For example, in a position which might normally be assumed by many performers, the left foot would be firmly planted on the floor or on an elevated footrest (not shown). The performer's right foot 14 might then lightly engage the floor merely to provide balance for the performer while being movable during an extended performance or practice in order to overcome body fatigue and to permit the performer to assume a more comfortable position.

In accordance with the preceding description, the chair has also been found to particularly facilitate positioning and manipulation of an instrument, such as a guitar or the like being used by the performer. A footrest or footstool of the type generally referred to above would be particularly desirable for positioning and manipulating an instrument such as a guitar.

The angular cut-away 22 is preferably formed at an angle of generally 30° relative to the axis 16 of the elongated seat portion 20. In this manner, the chair will best be adapted for a performer to sit with his legs at an angle of approximately 60° as represented by the angular relation for the lines 16 and 18. This angular relation has been found to provide generally maximum comfort for most performers. However, it will be obvious that the specific angle for the cut-off 22 may be varied depending upon the tastes of the individual performer and the specific use for the chair.

A relatively simple embodiment of a chair or stool constructed according to the present invention is indicated at 100 in FIG. 2 and includes a seat element 110 constructed as the seat element 10 of FIG. 1. The embodiment 100 includes a three-point support provided by three legs 112, 114 and 116 which are respectively secured to the seat element 110. Preferably, the two legs 112 and 114 are arranged along a rear surface 118 of the stool with the third leg 116 being arranged directly beneath the elongated portion 120 of the seat element 110. With the three legs 112–116 providing three-point support for the seat element in this manner, rigid support is provided for the seat element 110 while not interfering with movement of the performer's legs and feet in the manner described above with reference to FIG. 1.

Yet another embodiment 200 is illustrated in FIGS. 3–5. Referring to those figures in combination, a chair 200 is again provided with a similar seat element 210 having an elongated portion 220 and an angular cut-away as indicated on the opposite side of the seat element at 218. In the chair embodiment 200, the rear surface 216 of the seat element 210 is pivoted or hinged at 230 to a unitary support assembly 232 including a backrest 234 positioned above the hinge 230 and two leg portions 236 and 238 generally conforming with the two legs 112 and 114 of FIG. 2. A cross-piece 240 is interconnected between the bottom portions of the legs 236 and 238 for increased strength. A third leg 242 generally conforming with the third leg 116 of FIG. 2 is formed by a fabricated gate-leg assembly 244 which is hinged to the main support assembly 232 as indicated at 245.

With this combination of elements, the chair 200 may be erected into a position as illustrated in FIG. 5 with the legs 236, 238 and 242 providing three-point support for the seat element 210 in the same manner and in the same relative positions as the three legs for the chair or stool 100 of FIG. 2. With the seat element 210 in the erect position illustrated in FIG. 5, the performer may lean back against the backrest 234 with the seat element 210 providing all of the advantages described above with reference to FIG. 1.

when the chair 200 is not in use, the gate-leg assembly 244 may be rotated toward the other leg 236 and the seat element 210 may be folded downwardly to achieve the compact configuration illustrated in FIG. 3.

In order to assure that the stool remains in the erect position of FIG. 4, a bracket 246 is arranged on a lower surface of the seat element 210 to engage and position the gate-leg assembly 244. A positioning pin (not shown) could also extend upwardly from the top of the third leg to engage a positioning socket (not shown) on the bottom of the seat element 210 to similarly prevent undesired rotation of the gate-leg assembly 244. If desired, a friction catch 252 may also be arranged on the seat element for engaging a strike plate 254 on the gate-leg assembly 244 in order to lock the seat element 210 in the folded position of FIG. 3.

Yet another embodiment 300 of a chair constructed in accordance with the present invention is illustrated in FIGS. 6–9. The embodiment 300 also includes a seat element 310 constructed in accordance with the preceding description for the seat element 210 of FIGS. 3–5, the seat element 110 of FIG. 2 and the seat element 10 of FIG. 1. However, within the embodiment 300, the seat element 310 is preferably formed as a portion of an instrument case 350 which may be adapted to receive an instrument such as a guitar 352 for either storage or transport. The case 350 preferably forms a portion of the support structure for the seat element 310 and may even more preferably form a backrest for a performer using the chair. However, when the instrument and chair are not in use, both may be stored within the case 350 as illustrated in FIG. 6.

Referring now particularly to FIG. 7, the case 350 is fabricated to form two rigid support legs as generally indicated at 352 and 354 for the seat element 310. Here again, the two leg portions 352 and 354 are formed beneath the rear edge 368 of the seat element when the chair is erect. A third leg 356 conforming generally with the third leg 116 is formed as a solid cover element hinged to the instrument case at 358 adjacent the one leg portion 354. The seat element 310 is hinged at 359 to the upper edge of the third leg or cover element 356. The seat element 310 and third support leg 356 may be provided with similar locking means as described above with respect to FIGS. 3–5 in order to secure the seat and leg either in the erect position of FIG. 9 or the folded position of FIG. 6. Referring particularly to FIGS. 8 and 9, a bracket 362 on the seat element 310 engages a support catch 364 on the case to support and secure the seat element in the erect position shown in FIG. 9. The size of the seat element 310 and third leg element 356 are preferably selected to fit into a recess 360 formed by the case. When the chair is not in use, the bracket 362 is disengaged from the catch 364. The seat is then rotated downwardly to the position shown in FIG. 7 and the leg assembly 356 is rotated to the position of FIG. 6 to close the recess 360 in the guitar case. As was also described above with reference to FIGS. 3–5, additional locking means could be employed to secure the third leg assembly 356 in the closed or folded configuration of FIG. 6.

In the chair of FIGS. 6–9, a portion 366 of the case forms a backrest above the rear edge 368 of the seat element 310 (see FIG. 9). With the case being adapted to receive a guitar as shown in FIG. 6, the shape of the backrest also forms storage areas generally at 370 and 372 (see FIG. 6) which may be used for example to house music, a music stand and even a portable footrest, if desired (none of these three elements being shown).

Numerous modifications and variations are of course possible in addition to the preferred embodiments described above while remaining within the scope of the present invention. For example, a mirror image of any of the embodiments of FIGS. 1–9 could be used depending on whether the performer is right- or left-handed. Also, in the embodiment of FIGS. 6–9, the seat element 310 could be hinged directly to the case with bracket means engaging the seat element 310 with the leg assembly 356 in order to lock the chair in its erect position. Accordingly, the scope of the present invention is defined only by the following appended claims.

I claim:

1. A chair for musicians and other performing artists, comprising a seat element which is elongated upon one side for supporting one leg of a performer using the chair, the other side of the seat element being angularly cut away in order to permit freedom of movement for the performer's other leg, the seat element having generally a truncated, right triangular configuration with the elongated side of the seat element being generally perpendicular to a rear edge of the seat element and forming an acute angle with the angular cutaway, and a triangular support structure for the seat element.

2. The chair of claim 1 further comprising a backrest arranged above the rear edge of the seat element.

3. The chair of claim 2 wherein the backrest and two support points of the triangular support structure are formed by a unitary structure, the third support point for the triangular support structure being formed as a gate-leg which is pivotably interconnected with the unitary structure.

4. The chair of claim 3 wherein the seat element is pivotably connected along its rear edge to the unitary structure.

5. The chair of claim 3 further comprising means for locking components of the chair together in a folded and/or erect configuration.

6. The chair of claim 5 wherein pivotal interconnections between the seat element and the unitary structure and between the gate-leg and the unitary structure are formed by hinges.

7. The chair of claim 2 further comprising hinged connections for the seat element and the triangular support structure in order to permit the chair to be folded into a compact, portable configuration.

8. The chair of claim 1 further comprising hinged connections for the seat element and the triangular support structure in order to permit the chair to be folded into a compact, portable configuration.

9. The chair of claim 1 wherein the angle formed between the elongated side of the seat element and the angular cut-away is approximately 30 degrees.

10. A chair for musicians and other performing artists comprising a seat element which is elongated upon one side for supporting one leg of a performer using the chair, the other side of the seat element being angularly cut away in order to permit freedom of movement for the performer's other leg, a triangular support structure for the seat element and a backrest supported above the rear edge of the seat element, the seat element and triangular support structure being pivotably interconnected in order to permit folding of the chair into a compact portable configuration.

11. The chair of claim 10 wherein the backrest and two support points of the triangular support structure are formed by a unitary structure, the third support point for the triangular support structure being formed as a gate-leg which is pivotably interconnected with the unitary structure.

12. The chair of claim 11 wherein the seat element is pivotably connected along its rear edge to the unitary structure.

13. The chair of claim 12 further comprising means for locking components of the chair together in a folded and/or erect configuration.

14. The chair of claim 11 further comprising means for locking components of the chair together in a folded and/or erect configuration.

* * * * *